US007509920B2

(12) United States Patent
Taylor

(10) Patent No.: US 7,509,920 B2
(45) Date of Patent: Mar. 31, 2009

(54) INFLATABLE FENDER SYSTEM AND METHOD

(76) Inventor: Alan Taylor, 34655 E. State Rd. 70, Myakka City, FL (US) 34251

( * ) Notice: Subject to any disclaimer, the term of this patent is extended or adjusted under 35 U.S.C. 154(b) by 0 days.

(21) Appl. No.: 11/544,787

(22) Filed: Oct. 6, 2006

(65) Prior Publication Data

US 2008/0083364 A1 Apr. 10, 2008

(51) Int. Cl.
*B63B 43/02* (2006.01)
*B63B 17/00* (2006.01)
*B63B 7/00* (2006.01)

(52) U.S. Cl. ..... 114/360; 114/343; 114/345

(58) Field of Classification Search ..... 114/219, 114/292, 345, 360, 382, 61.1, 61.11, 61.25, 114/343

See application file for complete search history.

(56) References Cited

U.S. PATENT DOCUMENTS 3,988,997 A 11/1976 Fenton
4,055,136 A 10/1977 Fujisawa et al.
4,296,705 A 10/1981 Uruta et al.
4,970,980 A 11/1990 Eisner
5,215,031 A * 6/1993 Inman et al. ..... 114/360
5,725,265 A 3/1998 Baber
6,334,402 B1 * 1/2002 Gilligan ..... 114/354
6,371,040 B1 4/2002 Hemphill et al.
6,435,122 B1 8/2002 Skulnick
6,540,442 B1 4/2003 Slattery et al.
6,951,181 B1 * 10/2005 Lemke ..... 114/219

* cited by examiner

*Primary Examiner*—Lars A Olson
*Assistant Examiner*—Daniel V Venne
(74) *Attorney, Agent, or Firm*—Charles J. Prescott

(57) ABSTRACT

An inflatable fender system for protecting a watercraft from damaging contact with a permanent object, such as a dock, wharf, piling and rafted watercraft. Two elongated flexible substantially airtight tubular fenders are provided having a generally flat cross section when uninflated, rolled into a coil and stored at the stern of the watercraft. Each of the tubular fenders is independently extendable along a substantial portion of the length of the watercraft. A controlled air supply or AC or DC compressor on the watercraft is operably connected to each of the tubular fenders for independently selectively inflating and expanding the tubular fenders from the flat cross section during deployment. A hanger system, preferably including a plurality of hangers connectable in spaced relation between the watercraft and each of the tubular fenders support the tubular fenders during deployment to protect the side and gunnels of the watercraft.

2 Claims, 12 Drawing Sheets

S
102
104
90
92
94
96
98
100
106

INFLATABLE FENDER SYSTEM AND METHOD

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to physical damage protection devices for watercraft, and more particularly to an independently deployable, storable, inflatable fender or bumper system for protecting the sides of hulls of watercraft when coming in contact with docks, pilings and like fixed objects.

2. Description of Related Art

With considerable expense incurred when purchasing watercraft, owners have resorted to various means for protecting the sides and hulls of their vessel when docking and while being tied to a dock, wharf, piling and the like. Damage can also occur to the rub rail and gunnel of the watercraft when tied to a dock or wharf from wind and wakes from passing watercraft.

In order to minimize such damage, owners have used buoyant bumper devices removably connectable to the watercraft and such other devices as described herebelow. Typically, these include foam or air-filled members used only when docking and are removed when the watercraft is under way. These devices require owners to manually place and remove them and are thereafter placed inside the watercraft, taking up space.

U.S. Pat. No. 4,970,980 to Eisner teaches an inflatable bumper system for watercraft comprising a plurality of inflatable bladders and an air compressor for inflating various bladders to be inflated depending on need. The bumper system of the '980 patent is modular and adaptable to permit only the needed bumpers to inflate. A combined foam and inflatable collar assembly for watercraft is disclosed in U.S. Pat. No. 6,371,040 to Hemphill, et al.

An air bag system for vehicle bumpers is disclosed in U.S. Pat. No. 5,725,265 to Baber and U.S. Pat. No. 5,215,031 to Inman, et al. teaches inflatable bumpers mounted to the rigid hull of a boat with a mechanism for selectively inflating the bumpers. The first inflatable bumper mounted to the hull about the gunwale and a second inflatable bumper mounted at the waterline to keep the watercraft afloat.

Fujisawa, et al. teaches a multi-cell, air filled bag adapted for a dock fender in U.S. Pat. No. 4,055,136 and Fenton discloses an inflatable, weighted boat fender in U.S. Pat. No. 3,988,997. U.S. Pat. No. 4,296,705 to Uruta, et al. discloses a pneumatic marine fender comprised of a cylindrical barrel serving as a shock receiving face which is reinforced with cord layers for strength.

U.S. Pat. No. 6,435,122 to Skulnick discloses an inflatable boat fender in U.S. Pat. No. 6,435,122. U.S. Pat. No. 6,540, 442 assigned to the Secretary of the Navy teaches a "smart" bumper system with a variably controllable valve responsive to impact conditions for use with large and small marine vessels. The bumper includes fiber-reinforced high strain-to-failure viscoelastic matrix material.

The present invention includes two elongated airtight tubular fenders, which are expandable when in use, and are retractable when uninflated and storable into a rolled configuration within the structure of the watercraft. The inflatable fender system of the present invention may be user deployed or automatically deployed, each side of the fender system being independently deployable as required. The deployed tubular fenders are supported in many embodiments by a plurality of hangers connected in spaced relation between the watercraft and the tubular fenders.

BRIEF SUMMARY OF THE INVENTION

This invention is directed to an inflatable fender system for protecting a watercraft from damaging contact with a permanent object, such as a dock, wharf, piling and rafted watercraft. Two elongated flexible substantially airtight tubular fenders are provided having a generally flat cross section when uninflated, rolled into a coil and stored at the stern of the watercraft. Each of the tubular fenders is independently extendable along a substantial portion of the length of the watercraft. A controlled air supply on the watercraft is operably connected to each of the tubular fenders for independently selectively inflating and expanding the tubular fenders from the flat cross section during deployment. A hanger system, preferably including a plurality of hangers connectable in spaced relation between the watercraft and each of the tubular fenders support the tubular fenders during deployment to protect the side and gunnels of the watercraft.

It is therefore an object of this invention to provide an inflatable fender system for protecting a watercraft from impact or abrasive damage when being positioned against a permanent object or another rafted watercraft.

Still another object of this invention is to utilize economically manufactured airtight flexible tubular material utilized in fabricating fire hoses or the manufacture of iflatable boat materials such as PVC, hypalon, or EPDM rubber may be used for manufacturing an inflatable fender system for protecting the sides of a watercraft.

Yet another object of this invention is to provide an inflatable fender system which is easily rollable or coiled into a compact unit when deflated for storage aboard the watercraft.

Still another object of this invention is to provide an inflatable system for protecting a watercraft from contact damage against fixed or permanent objects which is easily deployable from a coiled or rolled uninflated configuration into a readily inflatable deployed orientation either manually or through the utilization of power winches.

Yet another object of this invention is to provide an inflatable fender system for protecting watercraft which is completely stored out of sight when not in use.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
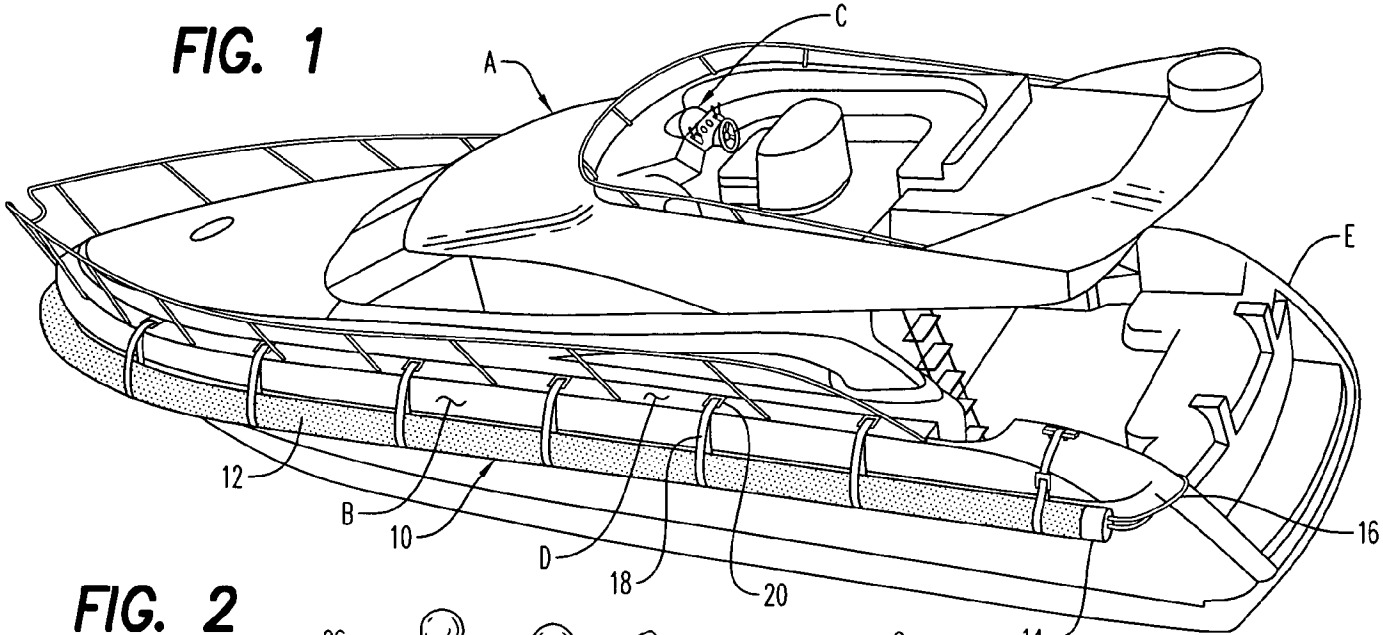
FIG. 1 is a perspective view of a typical power yacht showing one embodiment of the system deployed along the port or left side of the hull.
Figure 2:
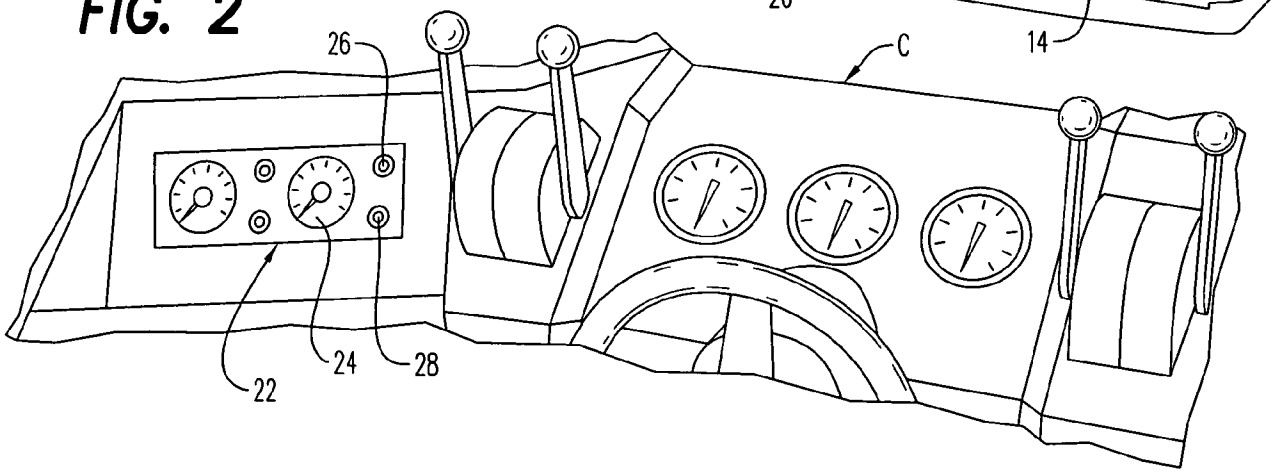
FIG. 2 is a perspective view of the fly bridge control station showing the pressure monitoring gauges and switches of the system.

Referring now to the drawings, and firstly to FIGS. 1 and 2, a pleasure yacht equipped with the invention is shown generally at numeral A. The invention in this embodiment is shown generally at numeral 10 and includes two elongated inflatable airtight tubular fenders 12, preferably formed of fiber reinforced E.P.D.M. rubber covered tubular fire hose material such as that used in fire hose installations or material such as PVC or hypalon used in the manufacture of inflatable boats. This stock tubular material is available as utilized in this invention under the trade name ARGUS fire hose as supplied by Kidde Fire fighting located in Exton, Pa., the dimensions of which are in the range of 3" to 12" in diameter having a wall thickness in the range of ⅛".

Shown deployed on the port side of the watercraft A, one of the tubular fenders 12 has been inflated and hung along the length of and just below the rub rail or gunnel C by a series of spaced apart flexible elongated hangers 18 which support the inflated tubular fender 12 from the bow to the corner of stern E of the watercraft A. These hangers 18 are releasibly attachable to mounting brackets 20 attached onto the deck D.

Figure 3:
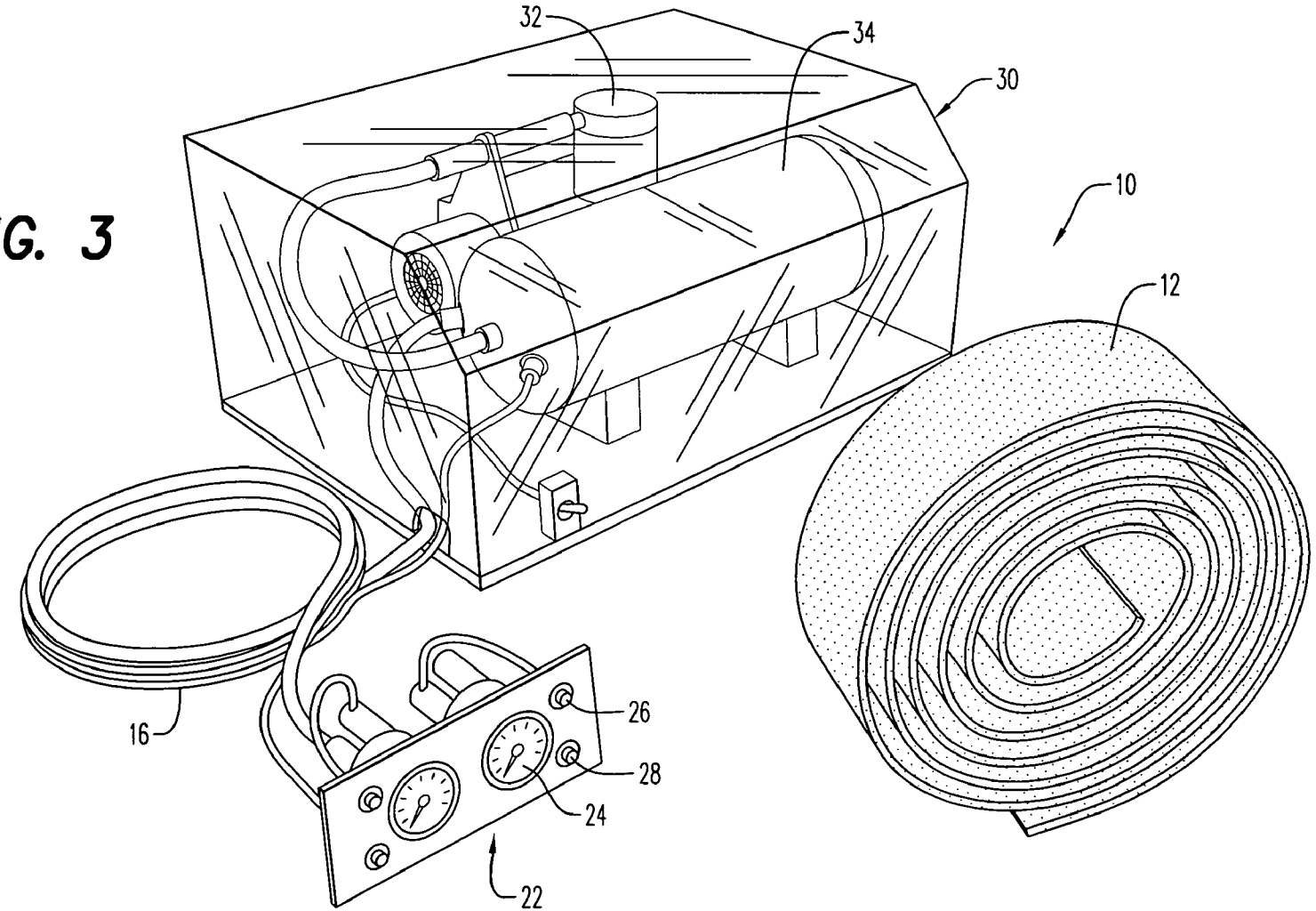
FIG. 3 is a perspective view of the basic components of the system.

An airtight fitting 14 is secured into each end of the tubular fender 12 and is in airtight communication via air hose 16 with an air pump supply system 30 shown in FIG. 3. These fittings 14 are available under the trademark HAND-TITE from Peterson Products Co. of Fredonia, Wis. or similar from Osburn Associates, Inc. of Logan, Ohio. An air pump 32 is utilized along with an accumulator 34 supplying desired low-pressure high-volume air via the air conduit 16. An air pressure/flow control module 22 mounted into the dash panel C shown in FIG. 2 both regulates air flow and pressure into and out of each of the tubular fenders 12 by control switches 26 and 28 as well as providing a pressure monitor gauge 24, again for each of the tubular fenders 12. Typical air pressure required to properly inflate each of these tubular fenders is in the range of up to 20 psi and therefore leakage and high pressure risks are substantially reduced with this arrangement.

An important aspect of this invention is that each of the tubular fenders 12 is easily deployed as the watercraft A approaches a dock, wharf or another watercraft for mooring or docking. In one of the manners described herebelow, the tubular fenders 12 are deployed along the outside of the length of the gunnel B either inflated or uninflated, secured through hangers 18 and deck attaching members 20 into the position shown either before or after inflation has occurred. The substantial resiliency of the pressurized and inflated tubular fenders 12 is substantial and will resist rupture and any impact damage to the hull by serving as an intermediate contact with the dock, a wharf, pilings, rafting against another vessel and the like.

Figure 4:
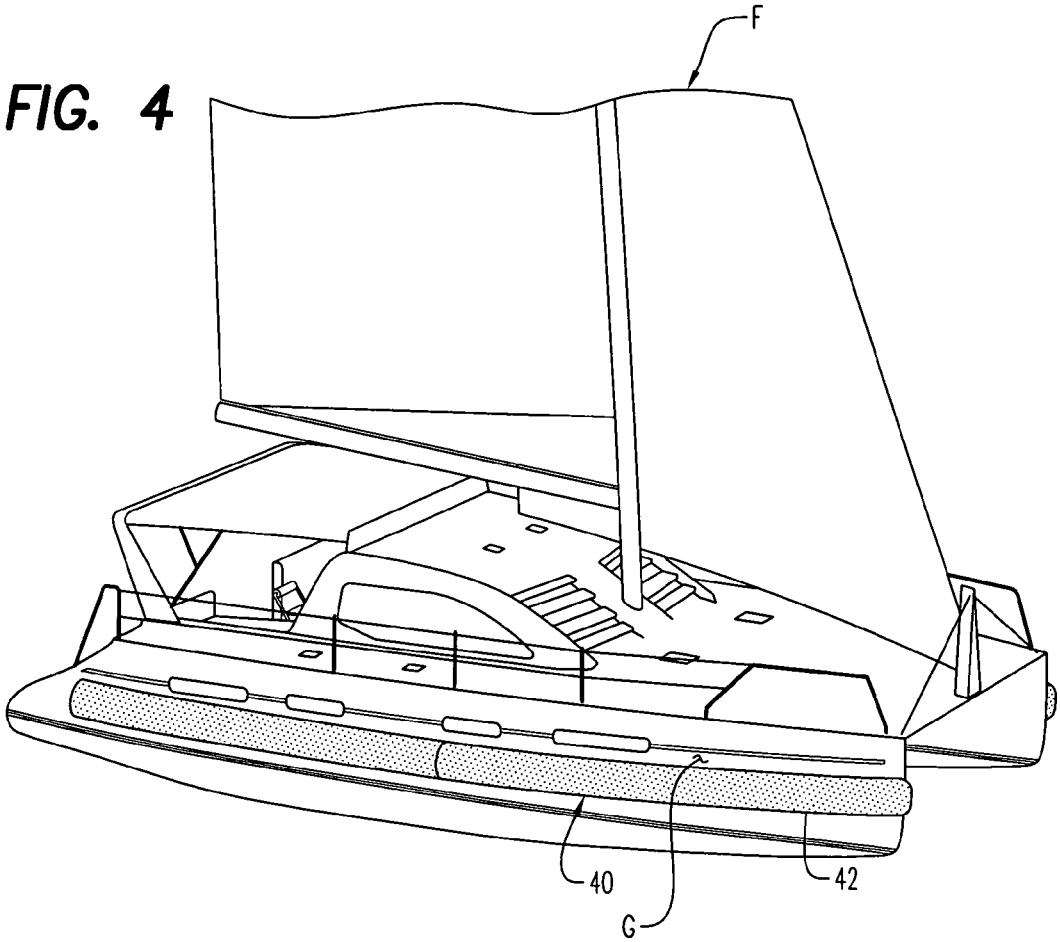
FIG. 4 is a perspective view of one embodiment of the system deployed along the hull of a catamaran.
Figure 5:
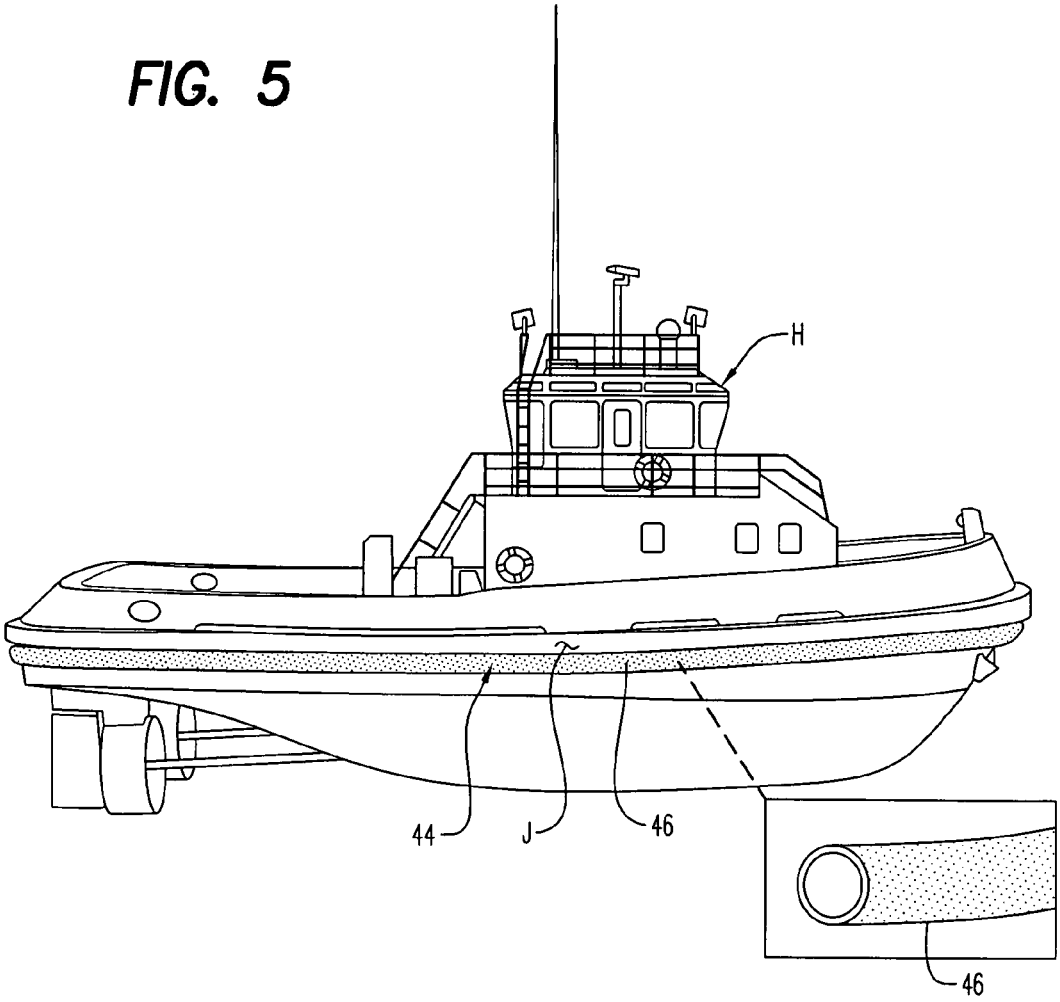
FIG. 5 is a side elevation view of the invention deployed along the sides of the hull of a tugboat.
Figure 6:
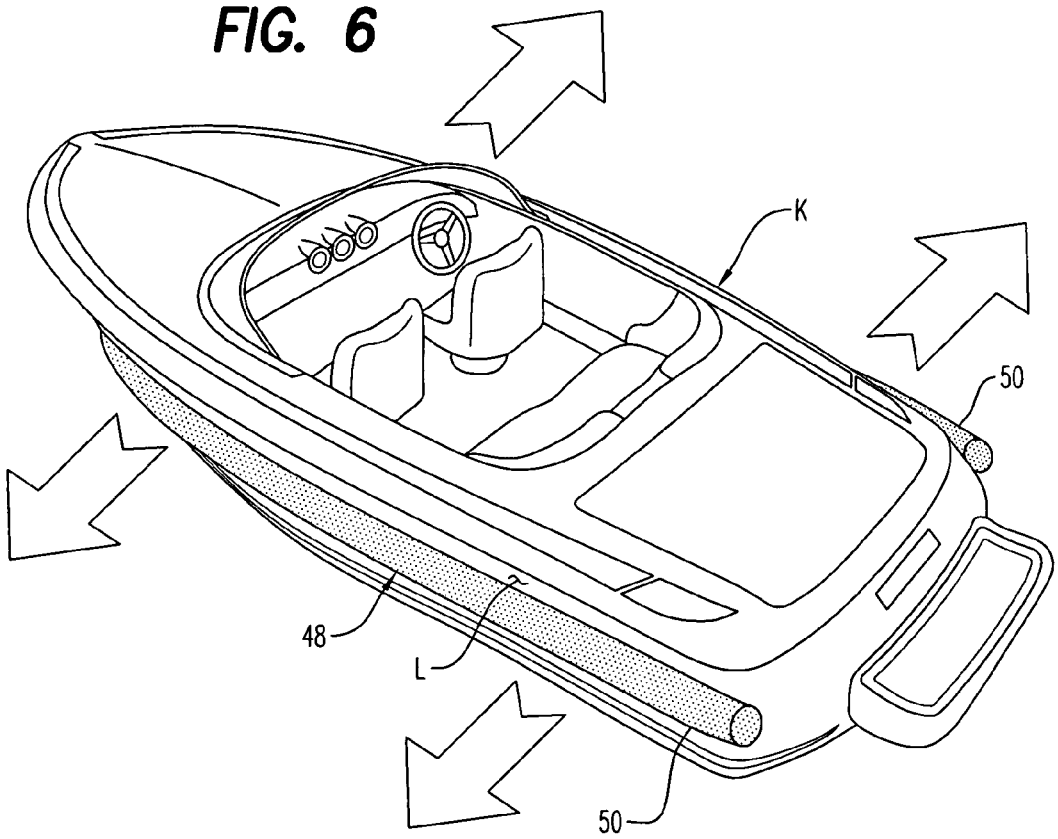
FIG. 6 is a perspective view of the invention deployed along both sides of a high performance pleasure craft.

Referring now to FIGS. 4 to 6, the adaptability of the invention to various other styles and types of watercraft is there demonstrated. In FIG. 4, a sailing catamaran F includes the fender system 40 having inflated tubular fenders 42 releasably deployed along the length of the sides of each of the hulls for dockage damage protection both while docking occurs and while being tied to a dock, wharf, piling or the like. In FIG. 5, a tugboat H is shown equipped with the invention 44 wherein the elongated inflatable airtight tubular fenders 46 shown deployed and inflated, protect the sides and hulls of this vessel H. A smaller pleasure craft K shown in FIG. 6 may also be equipped with the manually deployable embodiment 48 of this invention wherein the uninflated tubular fenders 50 are releasibly positioned along and just below one or both of the gunnels L, after which inflation thereof results in a completely protected damaging contact with a dock, piling, wharf, other rafted vessel and the like.

Figure 8:
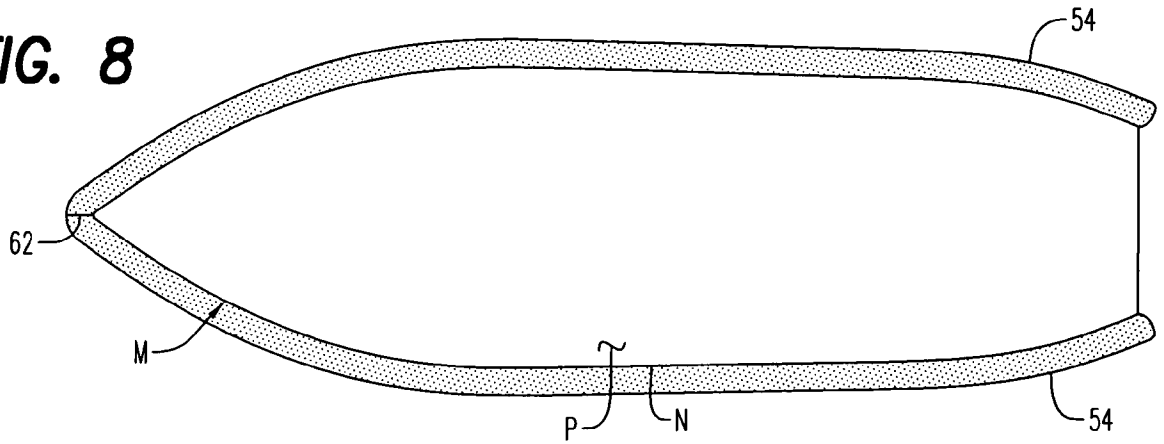
FIG. 8 is a simplified top plan view of FIG. 7.
Figure 7:
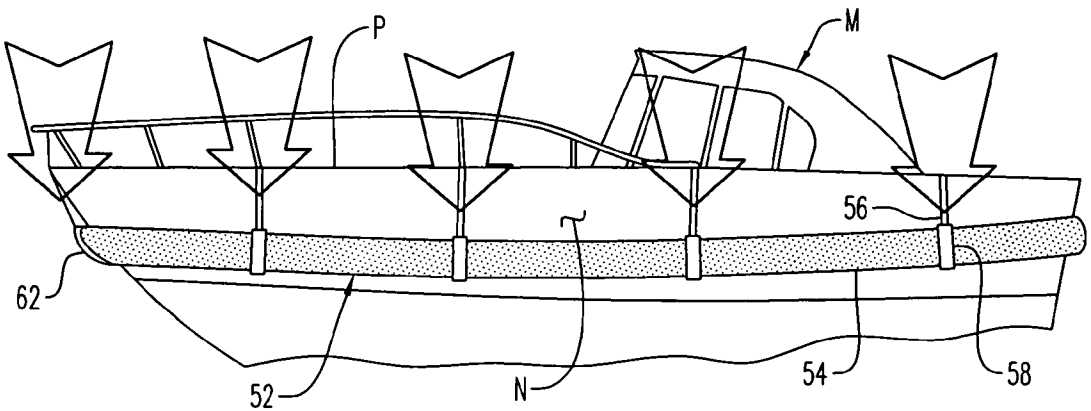
FIG. 7 is a side elevation view of another embodiment of the invention deployed along the sides of the hull of a typical cabin cruiser.
Figure 9:
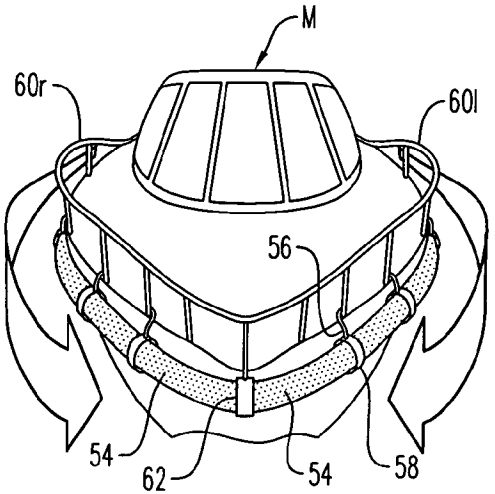
FIG. 9 is a front perspective view of FIG. 7.

Referring now to FIGS. 7 to 9, one broad concept of the invention is there shown generally at numeral 52 and which includes two elongated inflatable tubular fenders 54 hung in operative position along the sides of the hull N of vessel M. In this embodiment or aspect 52 of the invention, each of the tubular fenders 54 is joined at the bow at 62 with a suitable connector as each of the ends of each of the tubular fenders 54 have been sealingly capped by a suitable plug tightly fitted and cemented or clamped in place within the distal rounded ends of each of the tubular fenders 54. Each of the elongated hangers 56 is attached by flexible reinforcing rings 58 formed of an S.S. band or of a fabric material similar to that of each of the tubular fenders 54 as previously described. The hangers 56 are attached to the deck P in adjustable fashion so that vertical placement in the direction of the arrows in FIG. 7 may be accomplished.

Deployment of each of the tubular fenders 54 is from bins or storage bins 60*r* and 60*l* each positioned at the corresponding corners of the stern of the vessel M in a coiled or rolled up configuration when the tubular fenders 54 are uninflated. The material previously described for fabricating these tubular fenders 54 has a natural relaxed flattened configuration which greatly facilitates the invention by quickly self-deflating each fender 54 and allowing each of the tubular fenders 54 to be rolled up for storage within bins 60*r* and 60*l*. Deployment of each of the uninflated tubular fenders 54 up to the connection 62 is done in the direction of the arrows in FIG. 9 from the bins 60*r* and 60*l* manually until the full length of each of the hangers 56 is extended either prior to or after inflating of the tubular fenders 54.

Figures 10, 11, 12:
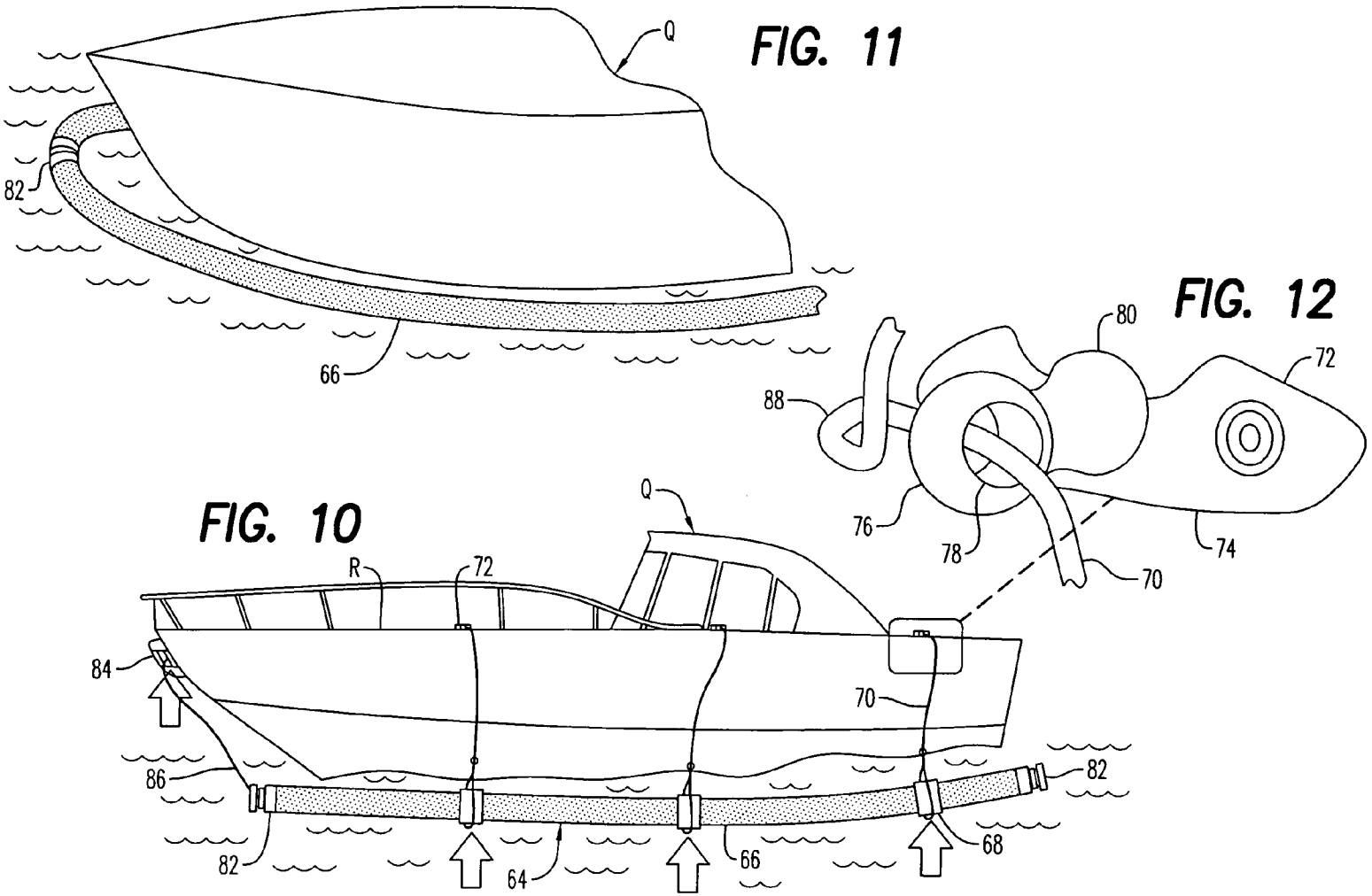
FIG. 10 is a side elevation view of another embodiment of the invention being deployed against the side hull of a cabin cruiser from the water.
FIG. 11 is an enlarged simplified perspective view of the bow area of FIG. 10.
FIG. 12 is an enlarged perspective view of a detachable lock and peg for conveniently securing the upper end of a flexible rope embodiment of a hanger of the system.
Figures 13, 14, 15, 16:
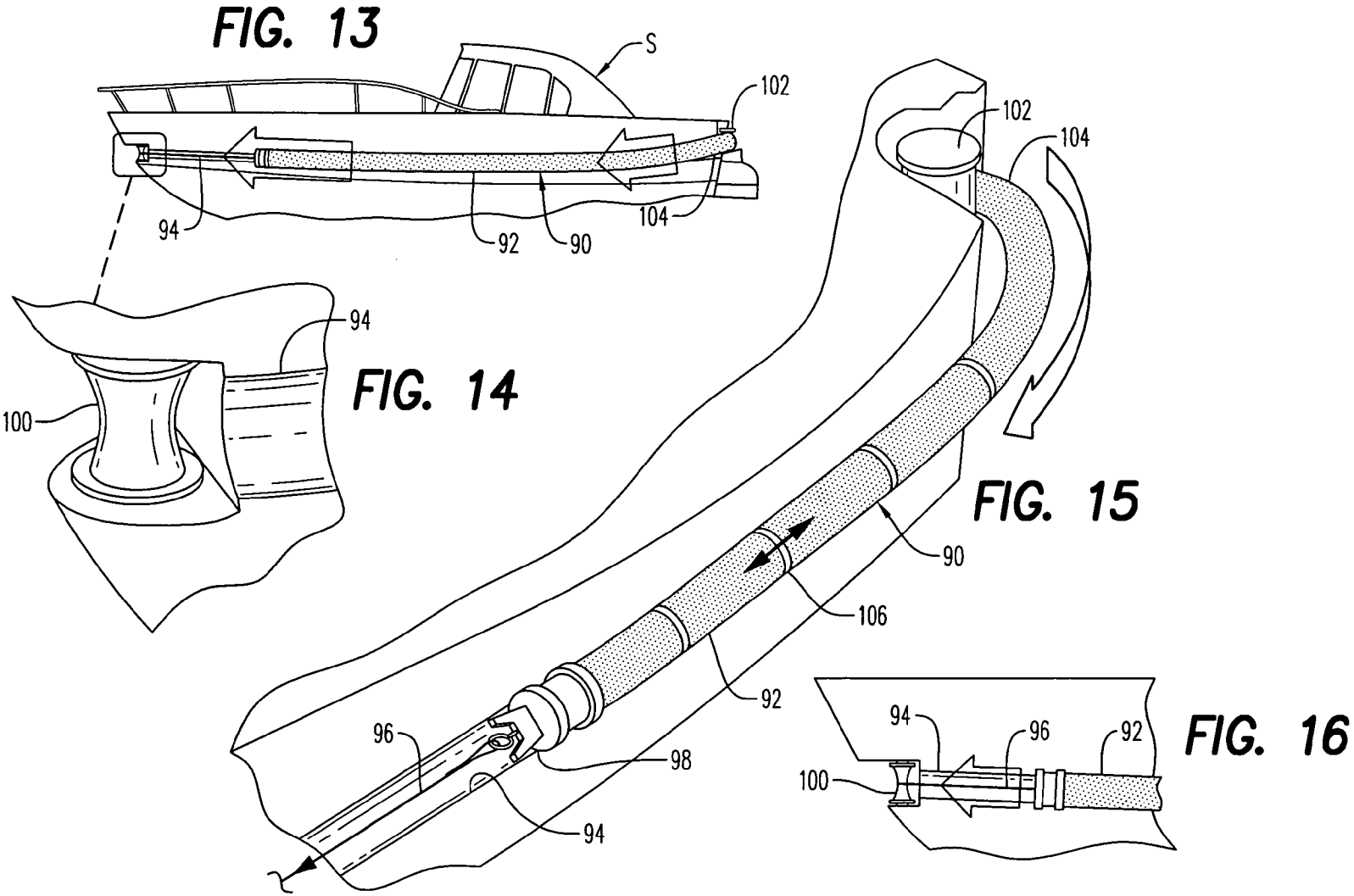
FIG. 13 is a side elevation view of another embodiment of the invention deployable along a rail attached to the side of the hull.
FIG. 14 is an enlargement of the bow winch of FIG. 13.
FIG. 15 is an enlarged perspective view of the stern area of FIG. 13.
FIG. 16 is a side simplified perspective view of the bow area of FIG. 13.
Figure 17:
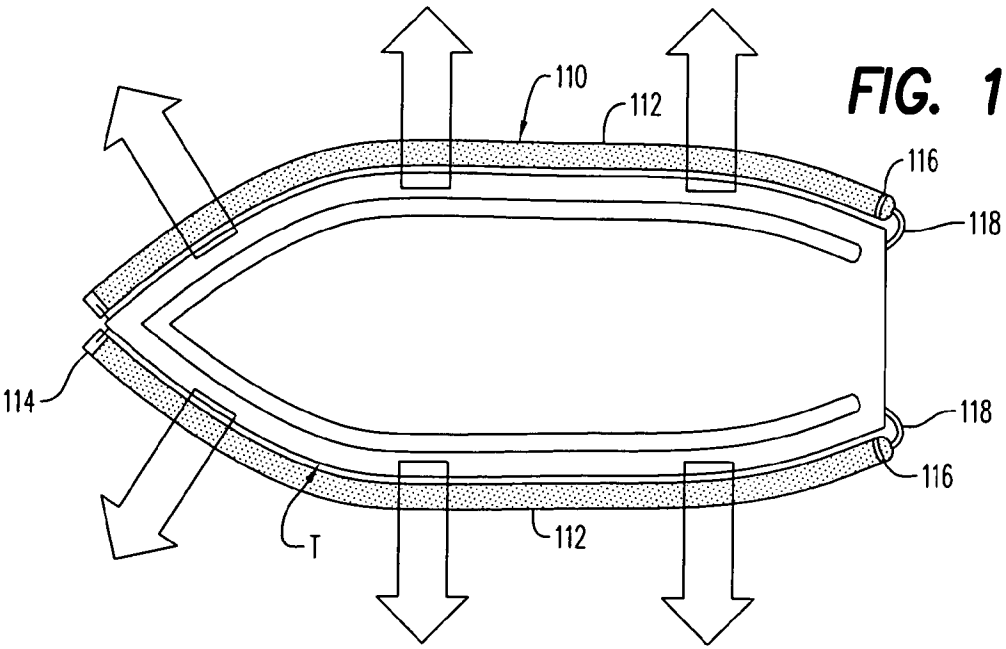
FIG. 17 is a simplified view of another embodiment of the invention deployed on either side of the hull of a pleasure craft.

Referring now to FIGS. 10 to 12, another embodiment of the invention is there shown generally at 64 and includes elongated tubular fenders 66 constructed as previously described. End fittings 82 are also shown absent the air conduit connection to the air pump supply system for clarity. In this embodiment 64, each of the tubular fenders 66 is initially deployed into the water after being air pressurized to maintain buoyancy. The connector 82 at the bow or forwardly end of the watercraft Q may be connected together as seen in FIG. 11, after which a bow winch or pulley mechanism 84 acting on a flexible rope 86 will lift the front portion of the connected tubular fenders 66 in the direction of the arrow. The remainder of the elongated hangers 70 are then manually shortened in the direction of those arrows to lift each of the tubular fenders 66 upwardly to the in-use position against the side of the hull of vessel Q.

A unique attaching arrangement in the form of a key cut metal plate lock 72 and peg 76 is utilized in this embodiment of the invention. The flexible rope 70 is fed through the eye 78 of peg 76 after it has been releasably attached to the lock or base 74 and knotted at 88 at a point along the length of the rope 70 as desired for proper height positioning of each of the inflated tubular fenders 66. This lock and peg arrangement is available under the trademark TAYLOR MADE identified as a FENDER LOCK & PEG. Thus, the uniqueness of this embodiment 64 is the relative ease of deployment of each of the tubular fenders 66 into the water in inflated configuration, after which the lifting of each of the inflated tubular fenders 66 is easily effected manually by a deck hand.

A more sophisticated embodiment of the invention is shown generally at numeral 90 in FIGS. 13 to 16. This embodiment 90 uses inflatable tubular fenders 92 as previously described but also utilizes an elongated traveler track 94 secured against the side of the hull and substantially coextensive with the length thereof. Cars are attached to bands 106 which slide freely along the length of each tubular fender 92 to facilitate deployment and retraction. These traveler tracks 94 and cars (not shown) are readily available from sailboat supply stores under the trademarks HARKEN AND LEWMAR. The uninflated tubular fenders 92 are stored in wound or reeled configuration on upright power reels 102 located at each corner of the stern of the vessel S.

When deployed, a bow winch 100 in operative engagement with the elongated flexible cables 96 attached to an airtight fitting 98 secured into the forwardly end of each of the tubular fenders 92 is operated to draw each of the tubular fenders 92 forwardly along track 94. To retract these tubular fenders 92, a power stern winch and reel 102 secured for rotation about an upright axis within each corner of the stern of the vessel S may be optionally provided so as to retract the tubular fenders 92 into a reeled up and stored uninflated configuration completely out of sight ready for redeployment at a later time.

Figure 19:
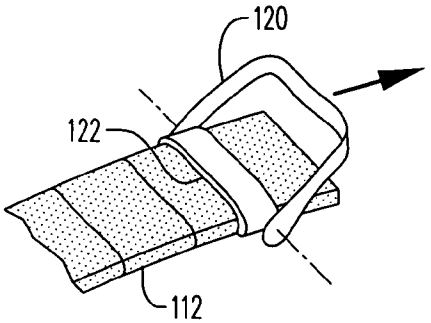
FIG. 19 is an enlarged view of the handle portion attached to the forwardly end of the uninflated tubular fender of FIG. 18.
Figure 18:
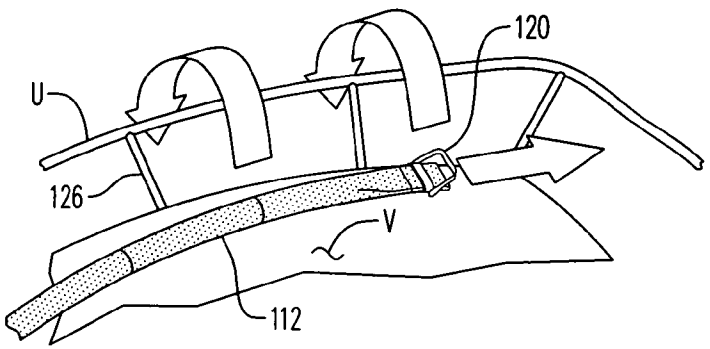
FIG. 18 is an enlarged perspective view of the foredeck area of the watercraft of FIG. 17 showing the uninflated tubular fender being deployed.
Figure 22:
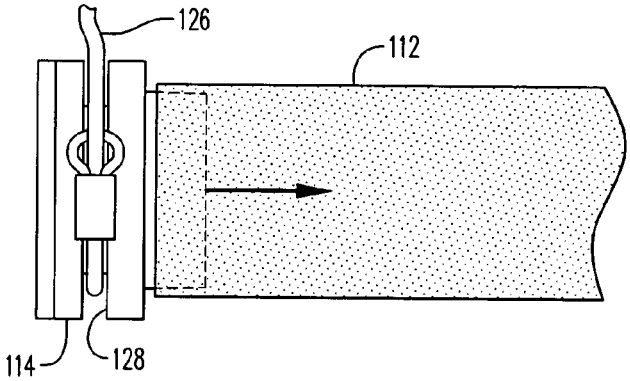
FIG. 22 is a side elevation view of FIG. 21 showing one end of the hanger secured in position.
Figure 21:
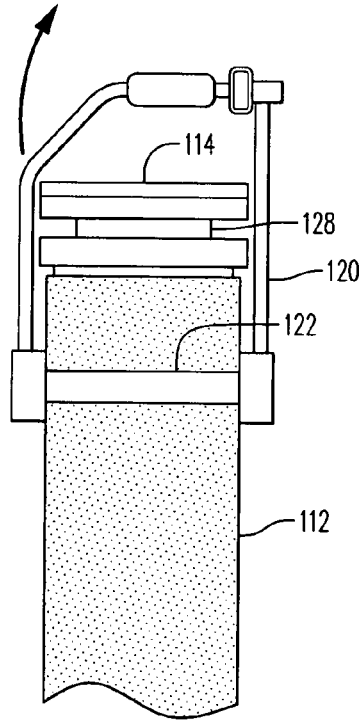
FIG. 21 is a top plan view of the detachable handle of FIG. 18.
Figure 20:
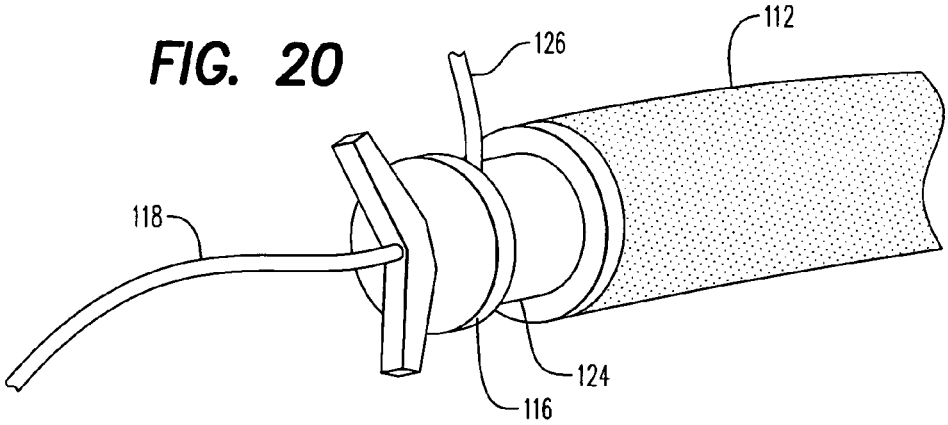
FIG. 20 is a perspective view of the rear or stern end of one of the tubular fenders of the system of FIG. 17.
Figure 23:
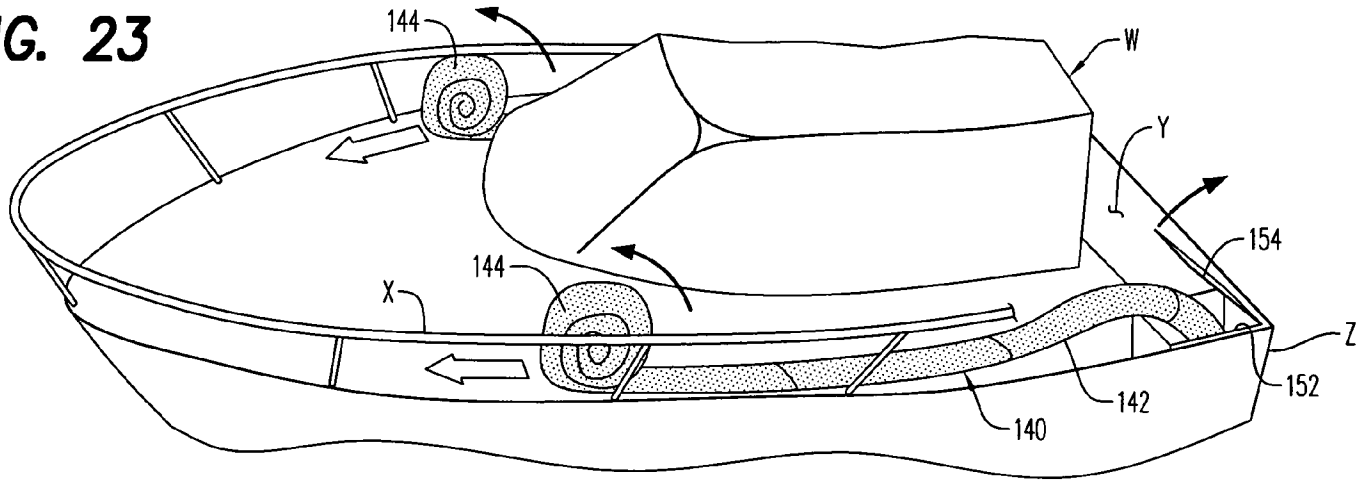
FIG. 23 is a perspective view of another watercraft showing another embodiment of the invention being deployed along the edge of the deck area.
Figure 25:
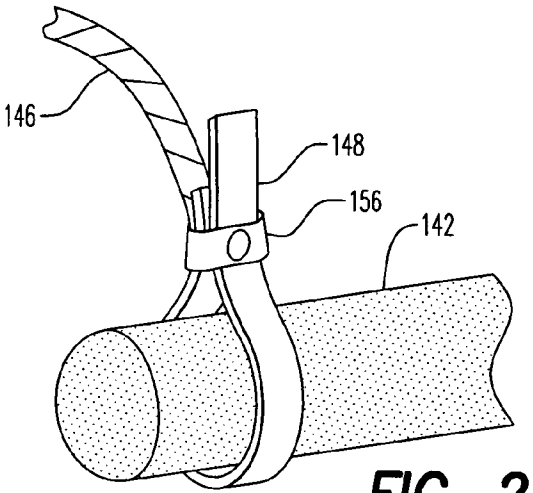
FIG. 25 is an enlarged view of the inflated tubular fender and hanger attached thereto of FIG. 24.
Figure 24:
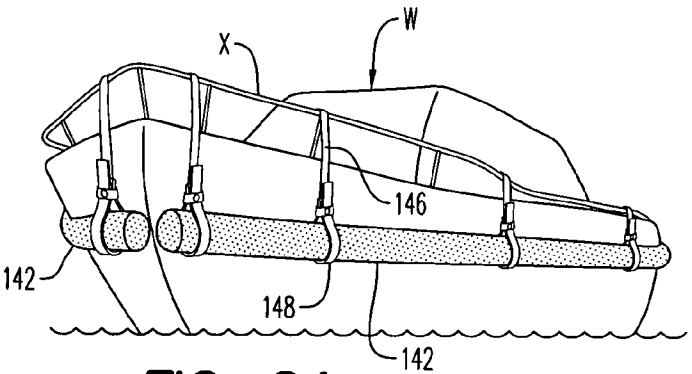
FIG. 24 is another perspective view of FIG. 23 showing the system after being deployed
Figure 26:
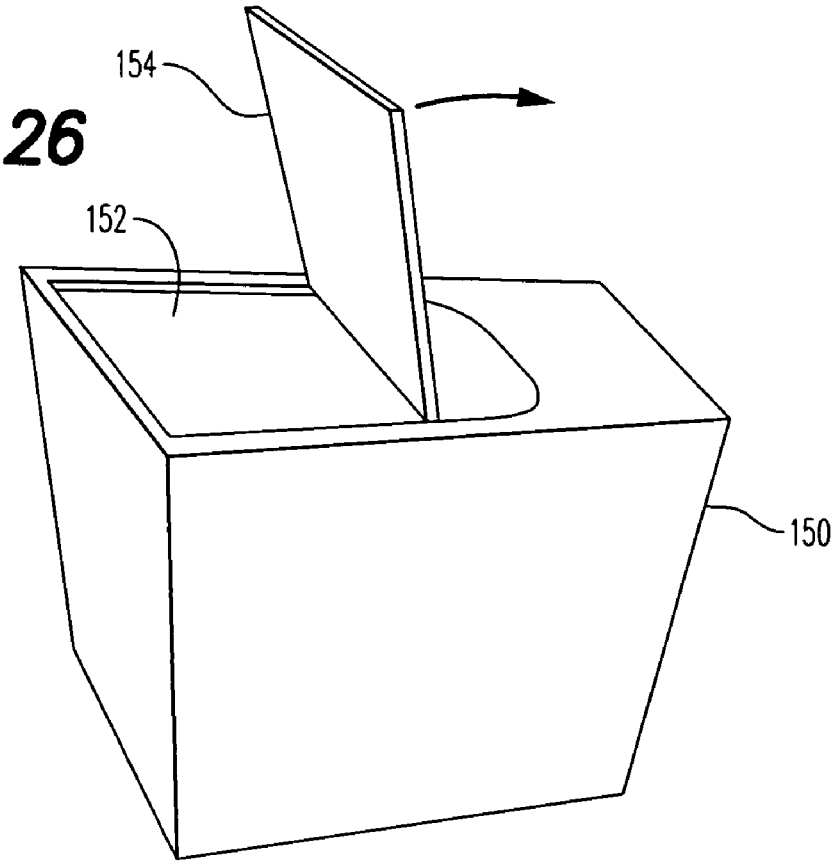
FIG. 26 is a perspective view of the storage compartment of FIG. 23.
Figure 27:
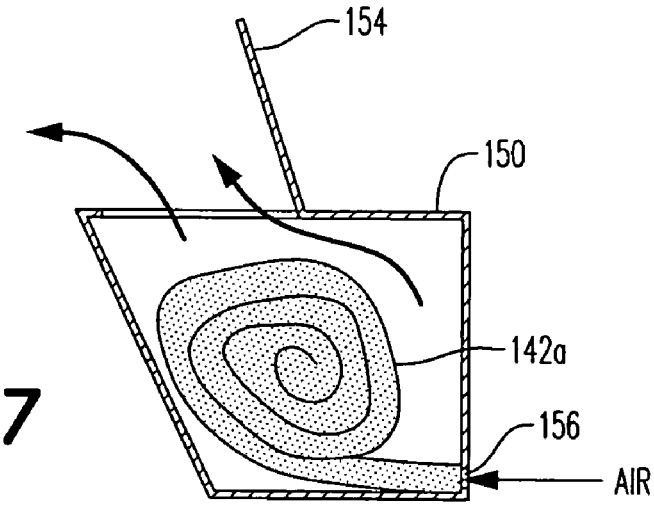
FIG. 27 is a simplified side elevation schematic view of the storage compartment of FIG. 23 showing the uninflated coiled tubular fender positioned therein when stored.

Still another embodiment of the invention is shown in schematic simplified form in FIGS. 17 to 22. In this embodiment, the outstretched inflated or uninflated tubular fenders 112 of this system 110 associated with vessel T are first dragged forwardly from the stern where the uninflated tubular fenders 112 are stored in coiled or rolled up configuration along deck V to the bow of the watercraft T. A detachable handle 120 may be releasably attached to the forwardly end of the uninflated tubular fender 112 by band 122 as seen in FIGS. 19 and 21.

The band 122 is structured so as to be releasable laterally so as to avoid the need for being pulled over the cylindrical airtight end plug 114 permanently secured into the forwardly end of each of the tubular fenders 112. The rear plug 116 is adapted to sealably interact with the air supply tubular fender 118 and to securely interengage with one of the flexible hangers 126. When deployed atop the deck V and properly inflated, after each of the elongated hangers 126 are secured to a handrail U, each of the inflated tubular fenders 112 is then tossed over the handrail U and hangingly supported against the side of the hull as previously described.

Another aspect of the invention is generally shown at numeral 140 in FIGS. 23 to 27 attached to watercraft W. In this embodiment 140, each of the elongated tubular fenders 142 are stored in uninflated rolled up configuration within a storage bin 150 best seen in FIGS. 26 and 27 built into the deck Y of the vessel W adjacent each stern corner Z thereof. The storage bin 150 includes a hatch 154 which is pivotally openable to the rear as shown by the arrow in FIGS. 23 and 26 whereupon the uninflated tubular fenders 142 may be rolled forwardly along the deck of the watercraft W fully toward or fully to the bow of the watercraft W. After being properly inflated, the tubular fenders 142 are deployed over the hand rail X and held in the vertical position against the hull of the watercraft W by flexible hangers or ropes 146 secured around each of the inflated tubular fenders 142, the height being adjustable by the proper movement of end portions 148 with respect to locking collar 156. Although this embodiment is also manually deployable and storable by one or more deck hands, the ease and simplicity of deployment and restorage of this system is to be appreciated.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. An inflatable fender system for protecting a hull of a watercraft from damaging contact with an object, comprising:

two elongated flexible substantially airtight tubular fenders having a relaxed generally flat cross section when uninflated and stored in a rolled up configuration and having a length sufficient for each of said tubular fenders to be extended along a substantial portion of the length of the watercraft;

an air supply on the watercraft operably connected to each of said tubular fenders for selectively inflating and expanding each of said tubular fenders from the flat cross section during deployment thereof;

a flexible hanger system suspended or suspendable from the gunnel or railing of the watercraft and vertically extending to support said tubular fenders protectively against the side and adjacent the gunnels of the watercraft;

said hanger system including an elongated hull track attached to and generally coextensive with a substantial portion of each of the sides of the watercraft;

each said tubular fender including a guide slidably engageable in a corresponding said track;

a bow winch positioned in general alignment with a forward end of each of said tracks;

a tow rope attached or attachable between said bow winch and a forward end of each of said tubular fenders wherein each of said tubular fenders may be extended in the corresponding said track from the uninflated rolled up configuration by operation of said bow winch.

2. An inflatable fender system as set forth in claim 1, further comprising:

a transom power reel mounted at each corner of the stern of the watercraft for supporting each of said tubular fenders in the flattened, rolled up configuration wherein each of said tubular fenders may be independently retracted and rolled up on the corresponding said power reel for storage.

* * * * *